US007481186B2

(12) United States Patent
Takahashi

(10) Patent No.: US 7,481,186 B2
(45) Date of Patent: Jan. 27, 2009

(54) ENGINE WITH COOLING WATER PASSAGE FORMED INSIDE CRANK CASE

(75) Inventor: Noriyuki Takahashi, Shizuoka (JP)

(73) Assignee: Yamaha Hatsudoki Kabushiki Kaisha, Shizukoa-Ken (JP)

( * ) Notice: Subject to any disclaimer, the term of this patent is extended or adjusted under 35 U.S.C. 154(b) by 37 days.

(21) Appl. No.: 11/674,016

(22) Filed: Feb. 12, 2007

(65) Prior Publication Data

US 2007/0186879 A1 Aug. 16, 2007

(30) Foreign Application Priority Data

Feb. 16, 2006 (JP) ..... 2006-039688

(51) Int. Cl.
*F01P 3/20* (2006.01)
*F01P 11/04* (2006.01)
*F02F 7/00* (2006.01)

(52) U.S. Cl. ..... 123/41.44; 123/198 R

(58) Field of Classification Search ..... 123/41.44, 123/41.72, 41.79, 195 C, 198 C, 196 AB, 123/41.74, 98 C; 180/229; 29/888.01; 165/51
See application file for complete search history.

(56) References Cited

U.S. PATENT DOCUMENTS 6,499,443 B2 * 12/2002 Kawamoto et al. ..... 123/41.44
6,912,987 B2 * 7/2005 Tachibana et al. ..... 123/198 R
2005/0263110 A1 * 12/2005 Yasui ..... 123/41.72
2006/0065215 A1 * 3/2006 Wachigai et al. ..... 123/41.1

FOREIGN PATENT DOCUMENTS

EP 0987416 A2 * 3/2000
JP 01-315650 12/1989

* cited by examiner

*Primary Examiner*—Michael Cuff
*Assistant Examiner*—Ka Chun Leung
(74) *Attorney, Agent, or Firm*—Hogan & Hartson LLP

(57) ABSTRACT

A cooling water structure for an engine with improved external appearance and reduced cost. A first passage section of a cooling water passage discharges cooling water from a water pump to water jackets of front and rear cylinders. The first passage section is formed in a surface of a partition wall of a right case that is an inside wall surface of a crank case. The water pump is accommodated with the first passage section in a crank chamber of the crank case.

12 Claims, 11 Drawing Sheets

[Fig. 1]
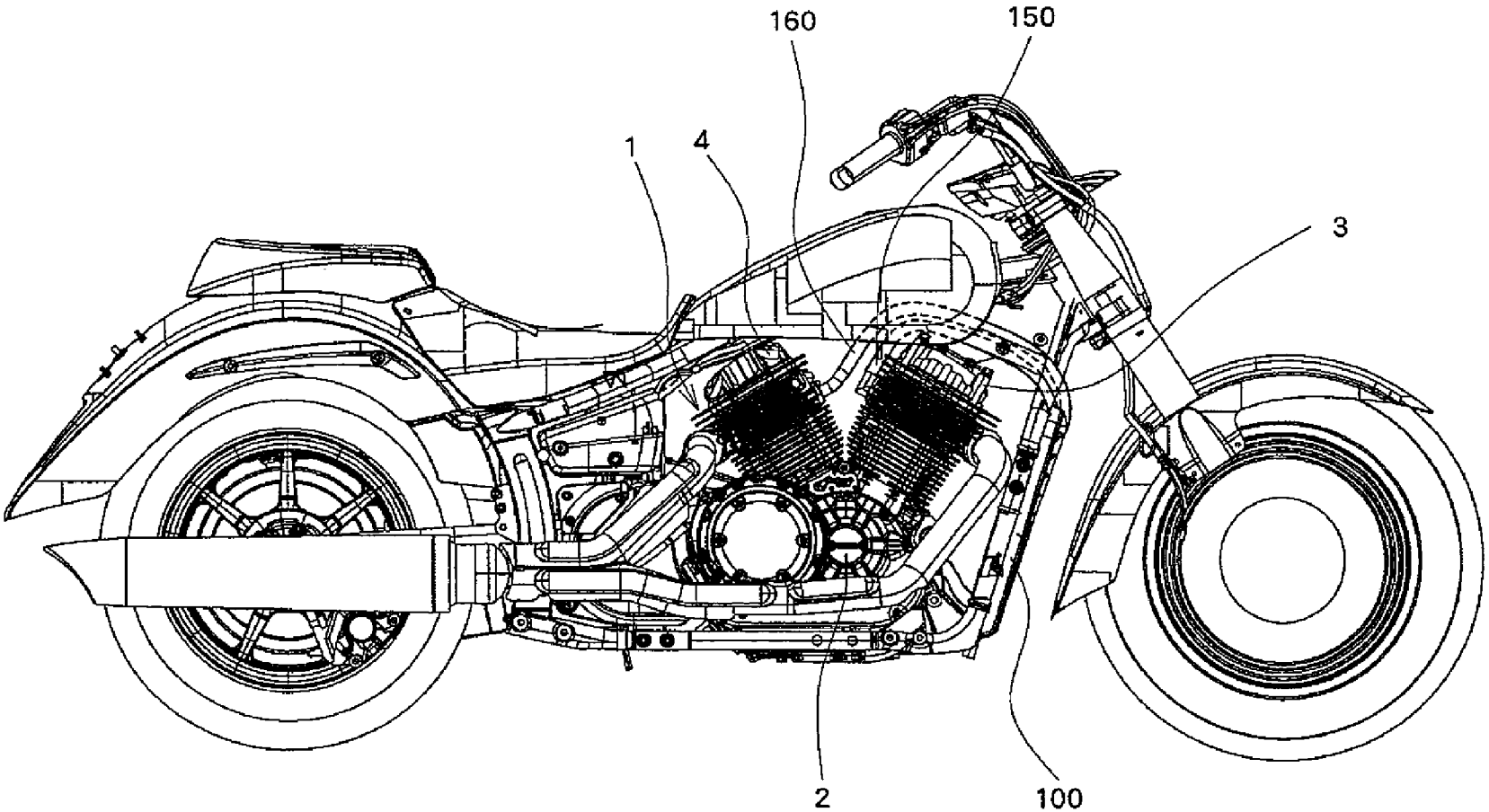

[Fig. 2]
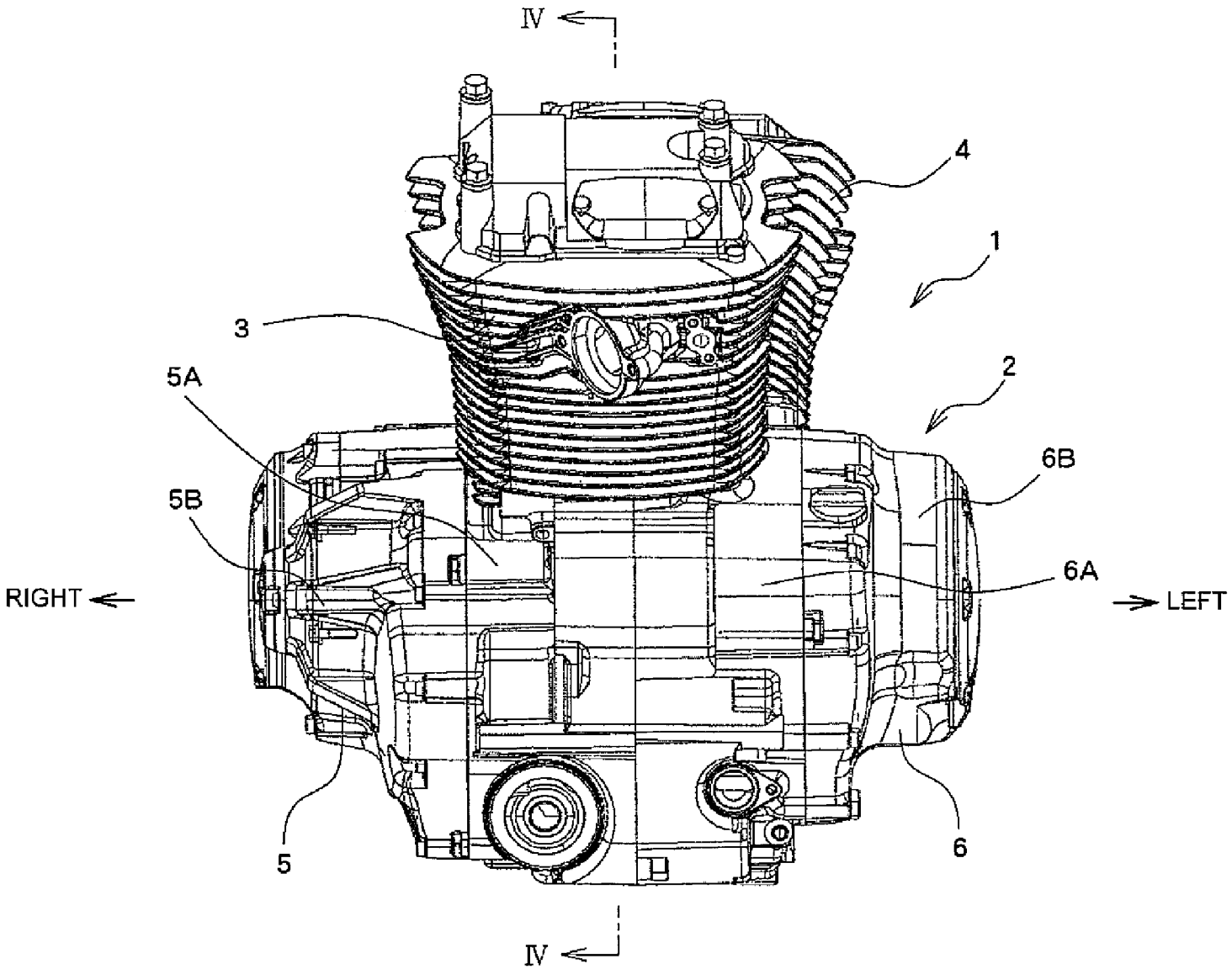

[Fig. 3]
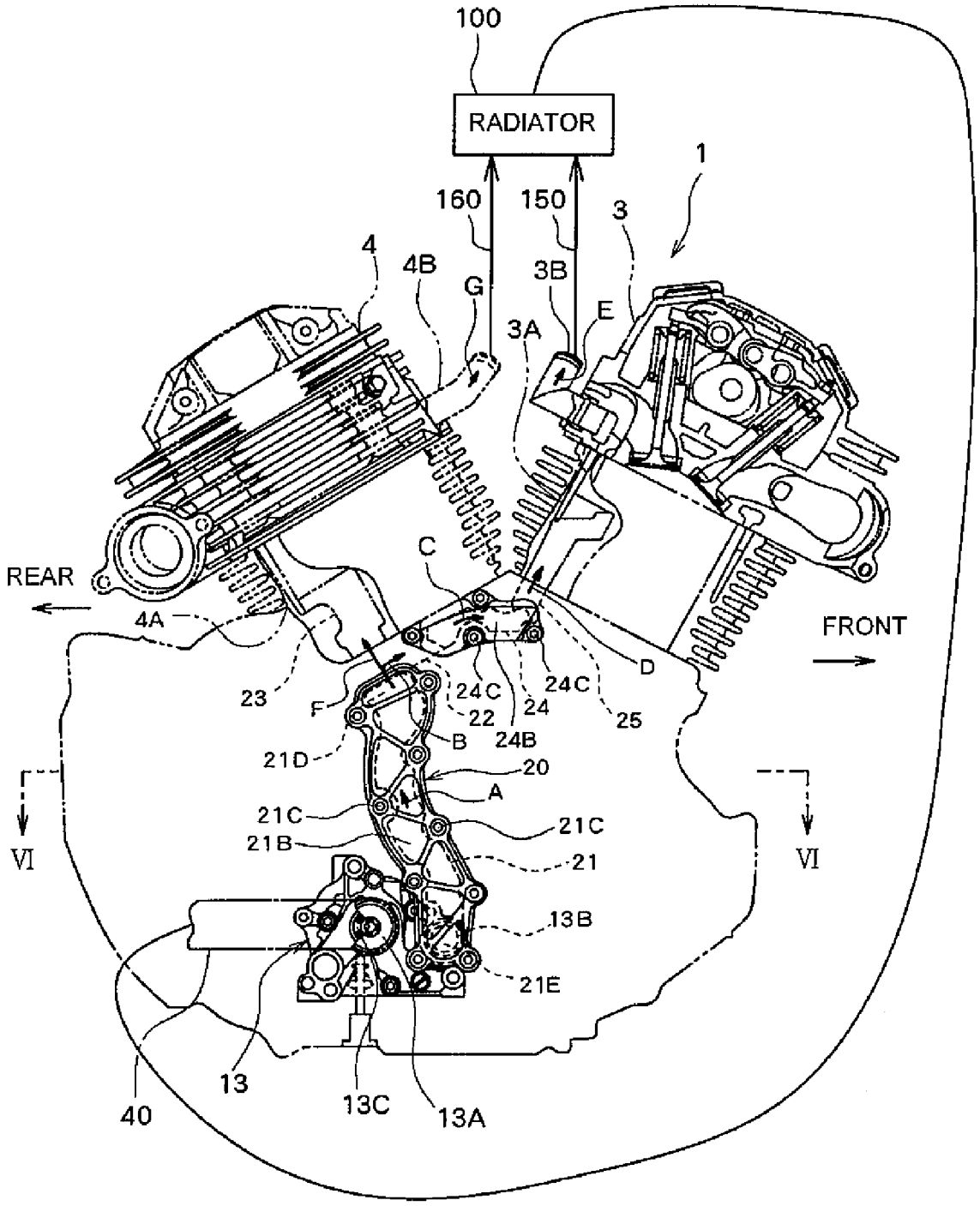

[Fig. 4]
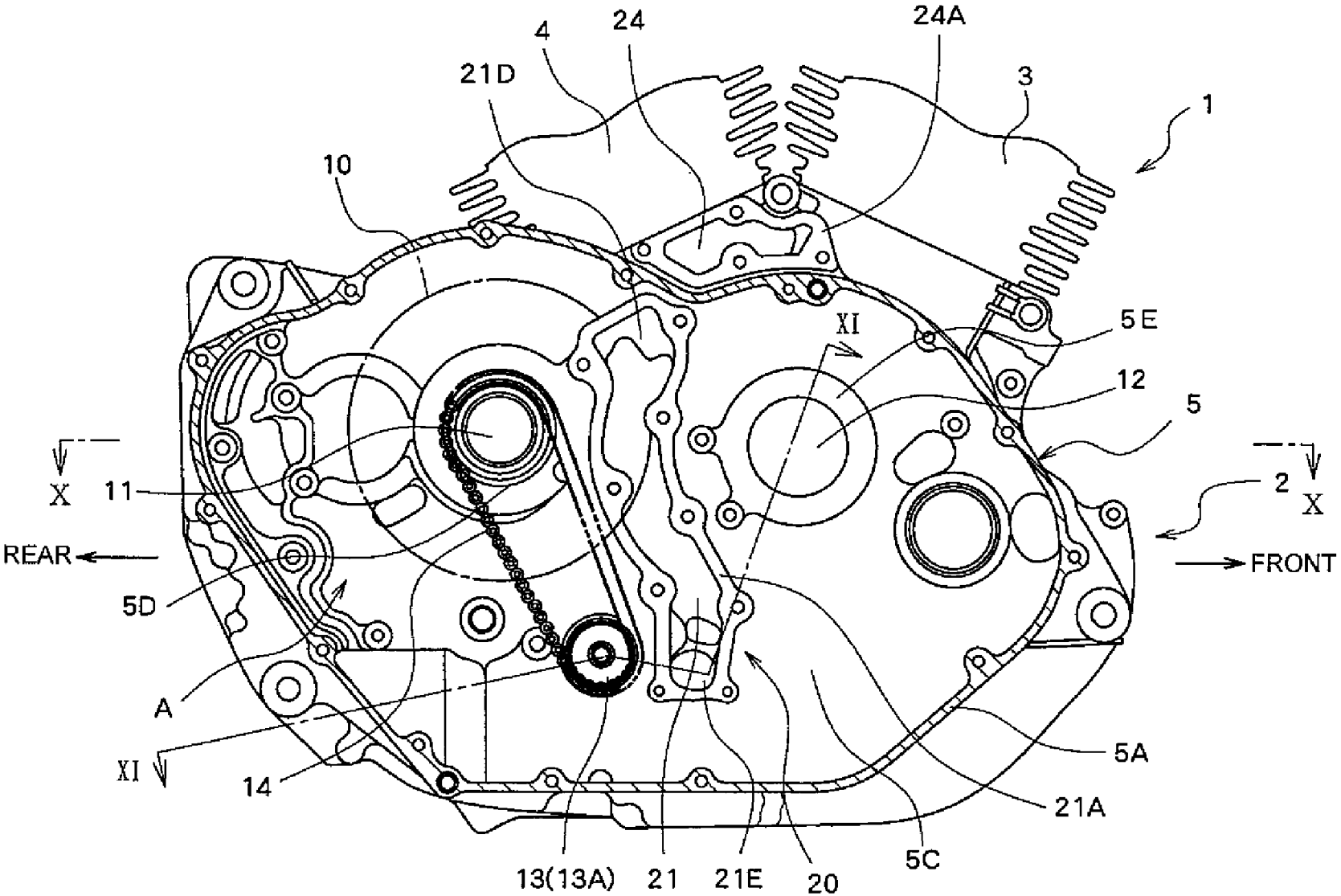

[Fig. 5]
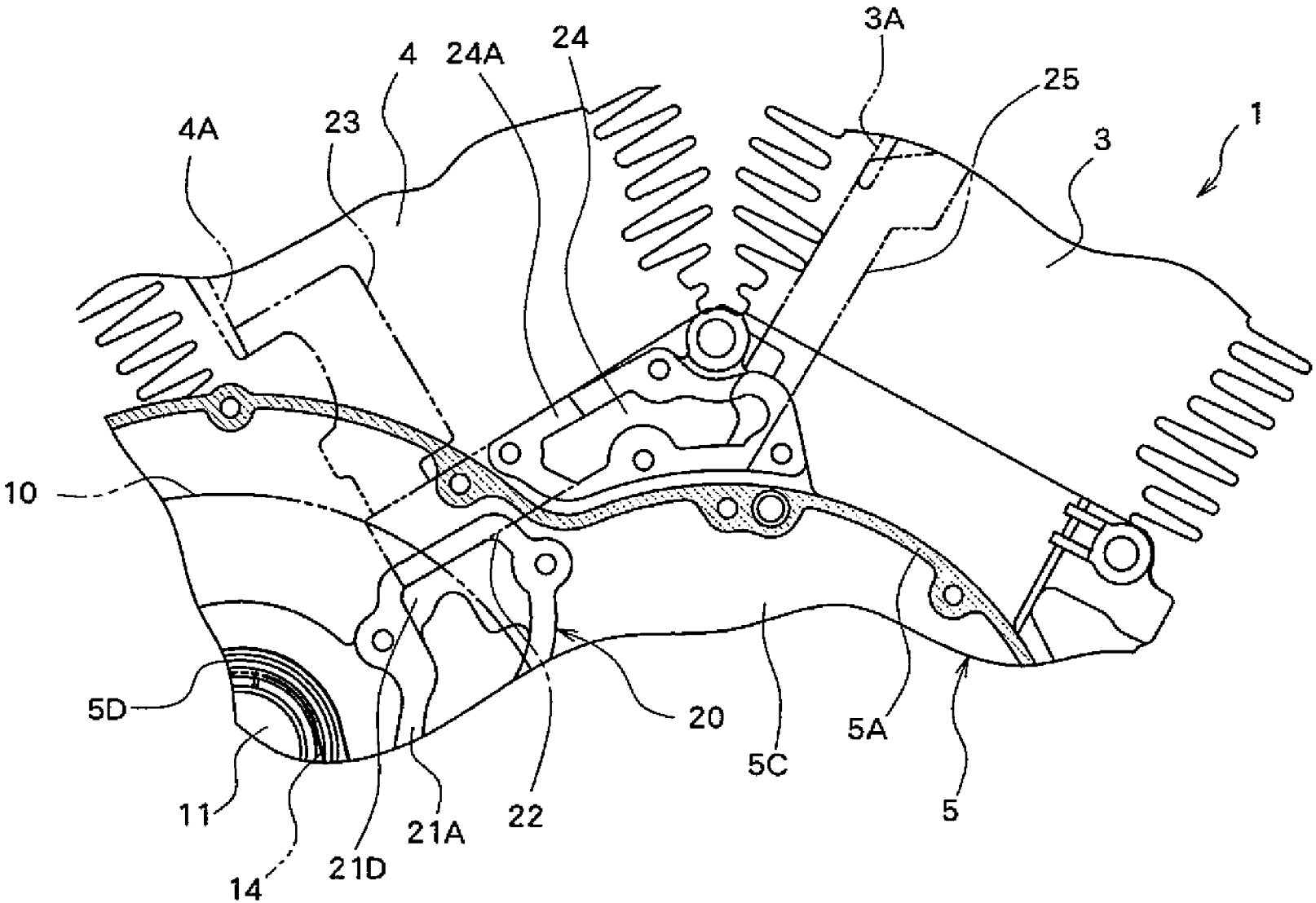

[Fig. 6]
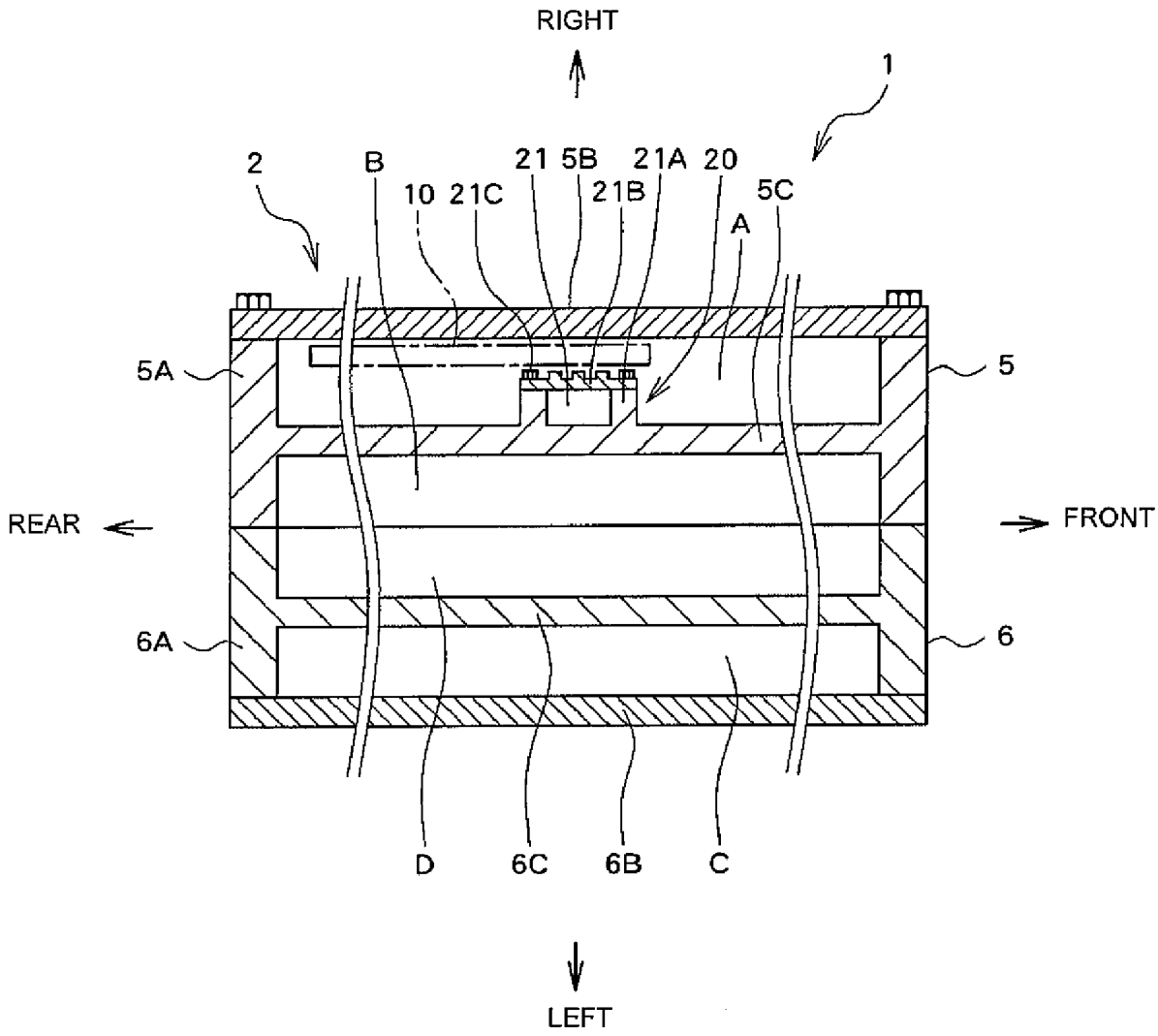

[Fig. 7]
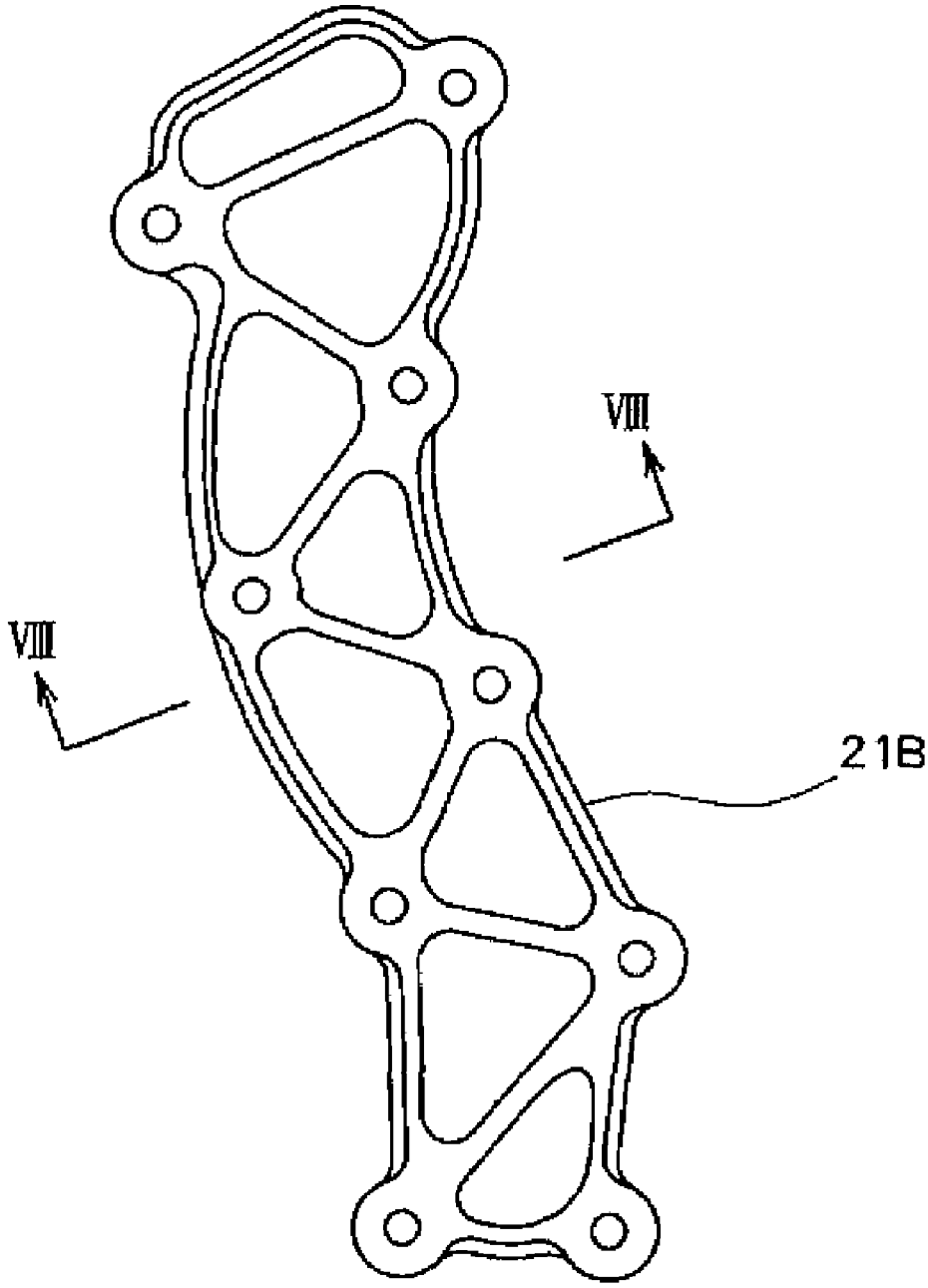

[Fig. 8]
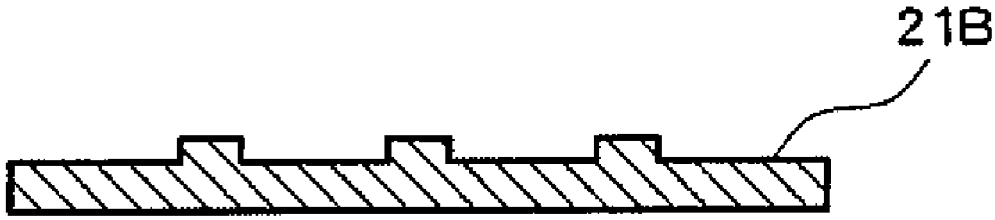

[Fig. 9]
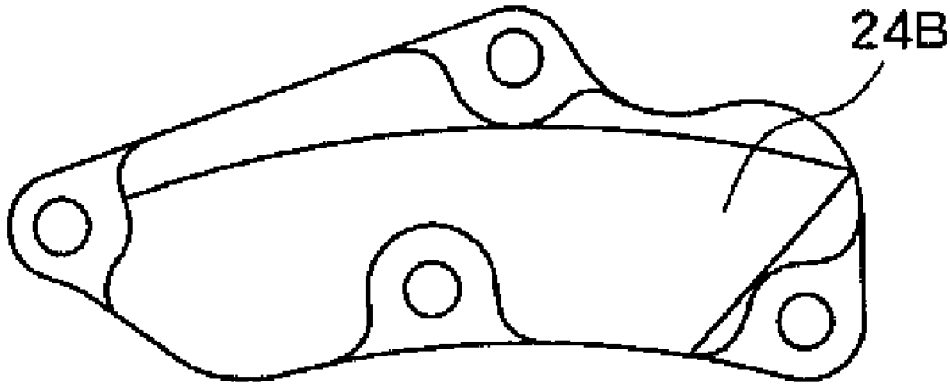

[Fig. 10]
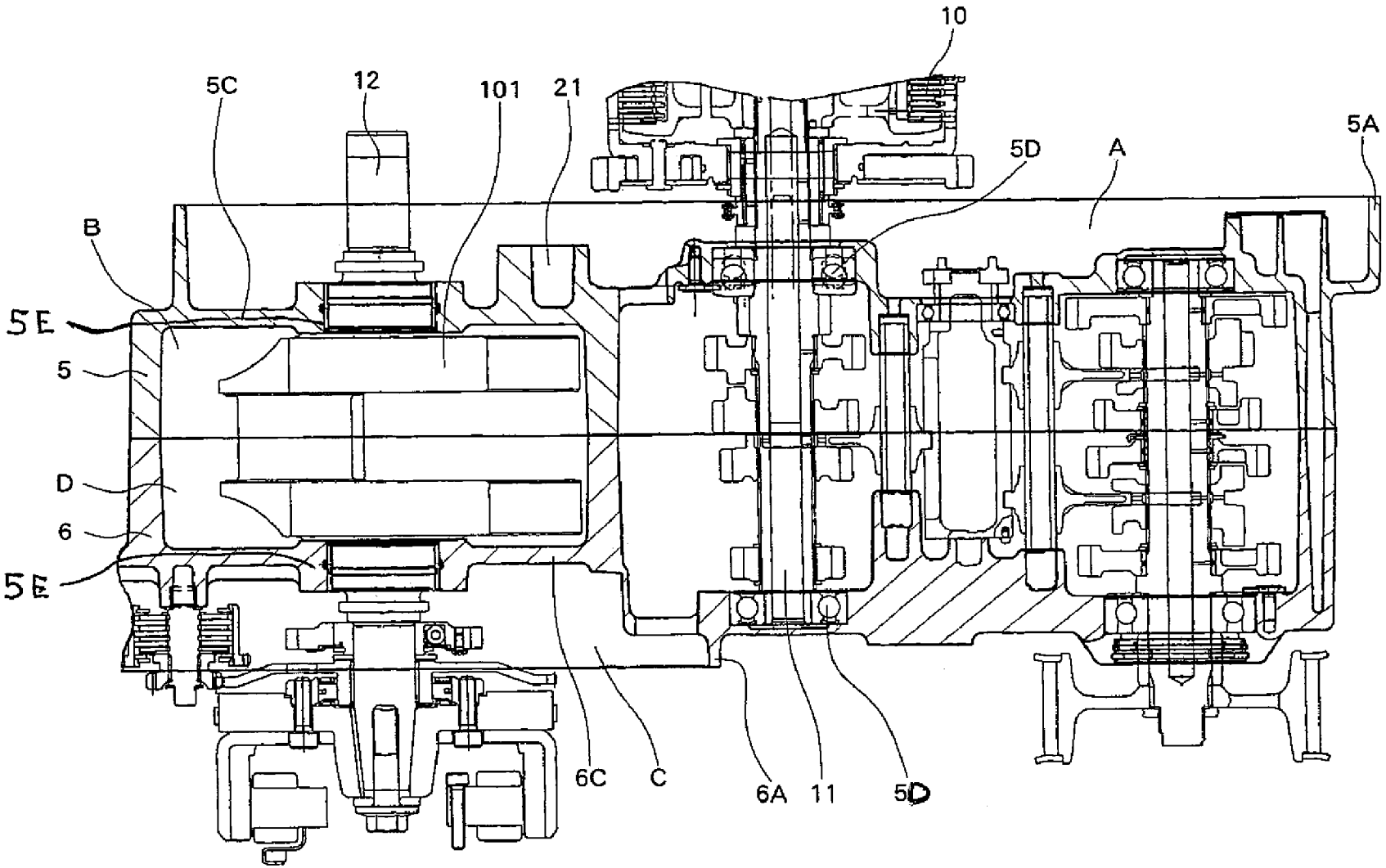

[Fig. 11]
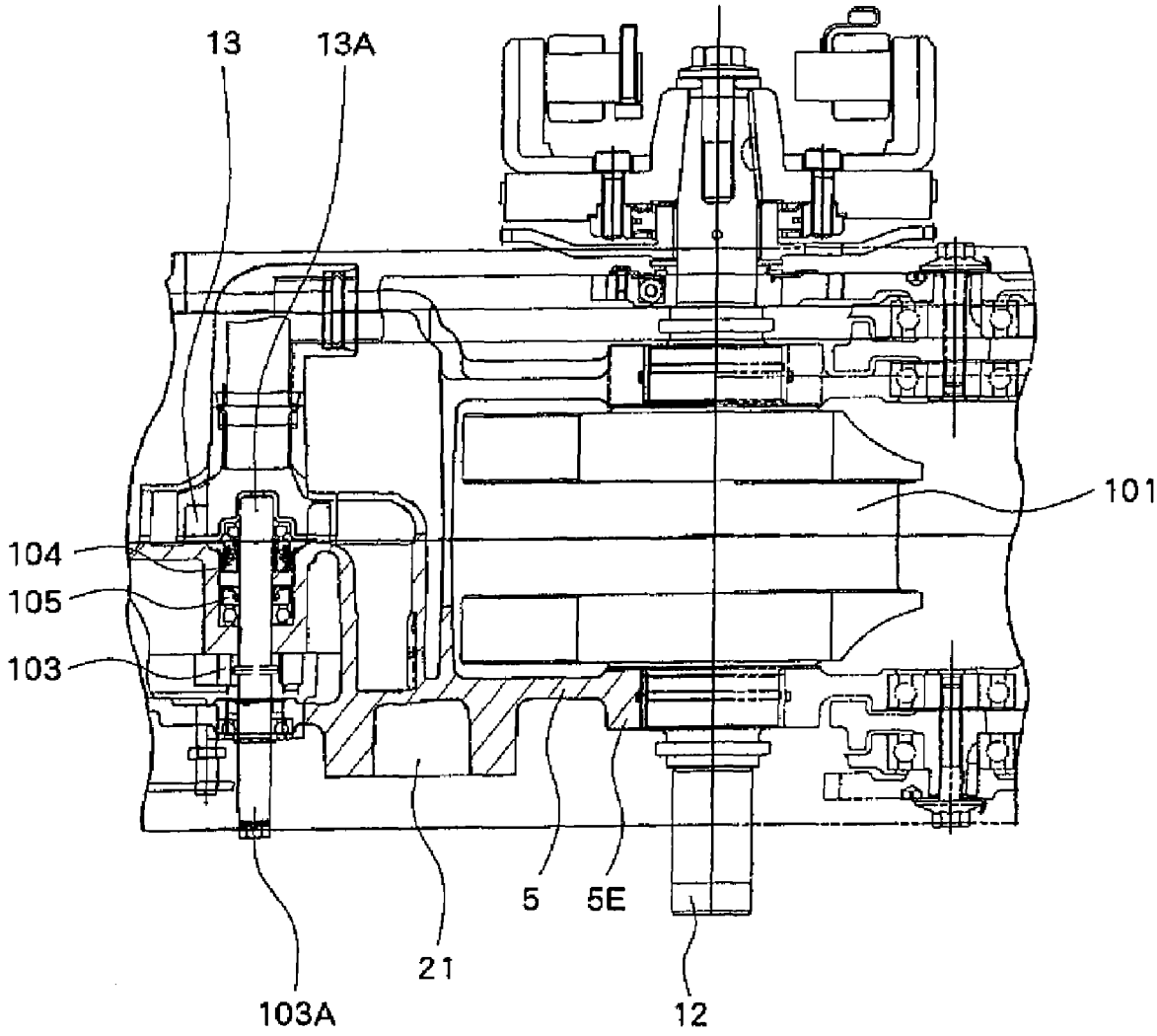

ENGINE WITH COOLING WATER PASSAGE FORMED INSIDE CRANK CASE

RELATED APPLICATIONS

This application claims the benefit of priority under 35 USC 119 of Japanese patent application no. 2006-039688, filed on Feb. 16, 2006, which application is hereby incorporated by reference in its entirety.

BACKGROUND OF THE INVENTION

1. Field of the Invention

The present invention relates generally to an engine, and more particularly to an engine that is mounted in a motorcycle.

2. Description of Related Art

Water-cooled motorcycle engines are known in which a water pump is provided at a lower side of the engine. Cooling water that is cooled by a radiator is supplied from the water pump to a water jacket provided at an upper section of the engine via a water pipe, a water hose or the like (for example, see JP-A-1-315650).

However, in such water-cooled engines, the water pipe, water hose and water pump are exposed outside of the engine. This exposed water piping and pump degrades the external appearance of the engine and increases manufacturing costs.

SUMMARY OF THE INVENTION

The invention has been devised in light of these problems and provides a water-cooled engine with improved external appearance and reduced cost.

An engine according to the invention includes a crank case; a water jacket; a water pump; and a cooling water passage that connects the water pump and the water jacket. The water pump is provided inside the crank case, and the cooling water passage includes a cooling water passage formed inside the crank case.

According to this structure, a section of the cooling water passage and the water pump are accommodated inside the crank case. As a result, the section of the cooling water passage and the water pump are not exposed to the outside of the engine, and the external appearance of the engine is improved. In addition, the cooling water passage is formed integrally with the crank case by casting or the like, thereby allowing water pipes and water hoses to be simplified or omitted.

In another aspect of the invention, a cylinder is connected to the crank case, and the water jacket is formed in the cylinder.

In this structure, cooling water is passed from the cooling water passage through the water jacket formed in the cylinder, thereby effectively cooling the cylinder.

In another aspect of the invention, the cooling water passage includes a passage side wall forming a frame shape that protrudes out from an inside wall of the crank case, and a passage cover provided on the passage side wall to close the frame shape of the passage side wall.

In this structure, the passage side wall is simply formed in an integrated manner using the inside wall of the crank case. Thus, formation of the cooling water passage is simplified.

In another aspect of the invention, a pump shaft of the water pump is disposed perpendicular to a flow direction of cooling water in the cooling water passage.

In this structure, the drive of the pump shaft of the water pump is used to smoothly discharge cooling water from the water pump to the cooling water passage.

In another aspect of the invention, the cooling water passage includes a first passage section formed to extend in an up-down direction, and the water pump is provided at a lower end of the first passage section.

In this structure, cooling water from the water pump is smoothly fed upward from a lower end of a section of the cooling water passage.

In another aspect of the invention, the water pump is provided with an oil pump, and a pump shaft of the oil pump is positioned coaxially with the pump shaft of the water pump.

In this structure, the pump shaft of the water pump can also be used as the pump shaft of the oil pump, reducing the size of the entire pump including the water pump and the oil pump.

Another aspect of the invention is a main shaft that supports a clutch plate, and a crank shaft. The main shaft and the crank shaft are supported by the crank case, and the cooling water passage is positioned between a main shaft support portion and a crank shaft support portion of the crank case.

In this structure, the cooling water passage is disposed in the space between the main shaft support portion and the crank shaft support portion, thereby simplifying the layout of the cooling water passage.

In another aspect of the invention, the crank case is formed from a left case and a right case, and the cooling water passage is formed in either the left case or the right case.

In this structure, the cooling water passage is easily formed along with the main shaft support portion and the crank shaft support portion in the crank case.

In another aspect of the invention, the engine is a V-type engine having a front cylinder and a rear cylinder.

Another aspect of the invention is a one side passage that connects the cooling water passage and a water jacket of the front cylinder, and an other side passage that connects the cooling water passage and a water jacket of the rear cylinder.

In this structure, the water jacket of the front cylinder and the water jacket of the rear cylinder are connected, thereby efficiently supplying cooling water.

In another aspect of the invention, the cooling water passage includes a fourth passage section that is positioned between the front cylinder and the rear cylinder, and that connects the first passage section and the other side passage.

In this structure, even if the front and rear cylinders are offset in the vehicle width direction, the water jackets of the front and rear cylinders are connected, thereby efficiently supplying cooling water.

In another aspect of the invention, the engine is mounted in a motorcycle.

According to the engine of the invention, a section of the cooling water passage and the water pump are not exposed to the outside of the engine as in the known art, thereby improving the external appearance of the engine. In addition, the cooling water passage is formed integrally with the crank case by casting or the like, thereby allowing the water pipes, water hoses and the like required in the known art to be simplified or omitted, and reducing manufacturing costs.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

FIG. 1 is a side view of a motorcycle mounted with an engine according to the invention.

FIG. 2 is a perspective view of the engine according to the invention,

FIG. 3 is a left side view of a cooling water passage and water pump according to the invention.

FIG. 4 is a cross sectional view of the engine taken along line IV-IV of FIG. 2.

FIG. 5 is a partial expanded cross sectional view of the cooling water passage of FIG. 4.

FIG. 6 is a cross sectional view of a crank case and the cooling water passage taken along line VI-VI of FIG. 3.

FIG. 7 is a plan view of the unit of a passage cover of a first passage section of FIG. 3.

FIG. 8 is an expanded cross sectional view of the passage cover taken along line VIII-VIII of FIG. 7.

FIG. 9 is a plan view of the unit of a passage cover of a fourth passage section of FIG. 3.

FIG. 10 is a cross sectional view of the engine taken along line X-X of FIG. 4.

FIG. 11 is a cross sectional view of the engine taken along line XI-XI of FIG. 4.

DETAILED DESCRIPTION OF THE INVENTION

A V-type 2-cylinder engine for a motorcycle according to an embodiment of the invention is explained with reference to FIGS. 1-11.

FIGS. 1 and 2 depict a V-type 2-cylinder engine 1 for a motorcycle. Engine 1 includes a crank case 2, a front cylinder 3, a rear cylinder 4 and a radiator 100. Water jackets 3A, 4A (FIG. 3) are formed in front and rear cylinders 3, 4. Crank case 2 has a right case 5 integrally formed with a left case 6. Water cooling pipes 150, 160 are connected at one end to front and rear cylinders 3, 4, and at another end to radiator 100 (FIG. 3). An intake pipe 40 is connected between radiator 100 and an intake port 13C of a water pump 13.

As seen in FIGS. 4, 6 and 10, right case 5 includes a periphery wall 5A that has an elliptic shape, a closing section 5B that closes a right end of periphery wall 5A, and a partition wall 5C that divides right case 5 into a clutch chamber A that accommodates a clutch plate 10, and a clutch chamber B that accommodates a crank 101. Clutch plate 10, as seen in FIG. 6, is accommodated inside right case 5 such that it is in a gap between closing section 5B and a cooling water passage 20.

Left case 6 is also provided with a periphery wall 6A, a closing section 6B, and a partition wall 6C. Partition wall 6C divides left case 6 to form a generator chamber C that accommodates a generator, and a crank chamber D.

A main shaft 11 that is positioned toward a rear section of partition wall 5C is rotatably inserted in a bearing 5D that is a main shaft support portion inside right case 5. Clutch plate 10 is provided in an end section of main shaft 11, and clutch plate 10 is driven to rotate by driving force of engine 1 transmitted to main shaft 11. A crank shaft 12 that is positioned toward a front section of partition wall 5C is rotatably inserted in a bearing 5E that is a crank shaft support portion inside right case 5. Crank 101 accommodated in crank chambers B, D is integrally attached to an end section of crank shaft 12.

As seen in FIGS. 3 and 4, water pump 13 is provided inside crank chamber B of crank case 2 (at the rear surface side of partition wall 5C shown in FIG. 4) at a position in the lower section thereof. A chain 14 is wrapped around a pump shaft 13A of water pump 13 and main shaft 11, and driving force of main shaft 11 drives pump shaft 13A to rotate via chain 14. As a result, as shown in FIG. 3, cooling water from radiator 100 is sucked up through intake pipe 40 connected to intake port 13C of water pump 13 to water pump 13. In addition, the cooling water is discharged to cooling water passage 20 from an outlet port 13B of water pump 13. Pump shaft 13A is positioned perpendicular to the longitudinal direction of cooling water passage 20. An oil pump 103 is provided integrally with water pump 13 and is driven by pump shaft 13A. Pump shaft 13A and the pump shaft of oil pump 103 are formed integrally and coaxially with each other. Oil pump 103 maintains pistons (not shown) and the like that are housed in front cylinder 3 and rear cylinder 4 in a lubricated state. Water pump 13 and oil pump 103 are structured such that, as seen in FIG. 11, a mechanical seal 104 and an oil seal 105 seal the cooling water that passes through water pump 13 from the oil that passes through oil pump 103.

Next, cooling water passage 20 is explained. Cooling water passage 20, as seen in FIGS. 3-5, is formed from a first passage section 21, a second passage section 22, a third passage section 23, a fourth passage section 24, and a fifth passage section 25. First passage section 21 extends along a surface of partition wall 5C that is the inside wall surface of crank case 2 in an up-down direction. Second passage section 22 is formed in a recessed manner inside crank case 2, has an open upper side, and extends from an upper end 21D of first passage section 21 to the front. Third passage section 23 is formed inside crank case 2 and inside rear cylinder 4, is connected with second passage section 22, and extends diagonally rearward and upward from a rear end of second passage section 22. Fourth passage section 24 is formed in crank case 2, is connected to a front end of second passage section 22, and extends further forward from the front end side. Fifth passage section 25 is formed inside crank case 2 and inside front cylinder 3, is connected to the front end of fourth passage section 24, and extends forward and diagonally upward from the front end of fourth passage section 24.

Fifth passage section 25 corresponds to a "one side passage" of the claims, and second passage section 22 and third passage section 23 correspond to an "other side passage" of the claims.

First passage section 21 is formed from a passage side wall 21A and a passage cover 21B (FIGS. 7 and 8). Passage side wall 21A is a frame like member having a substantially rectangular shape that protrudes out from the surface of partition wall 5C of crank case 2 and extends along the surface in an up-down direction between an opening of bearing 5D of main shaft 11 and an opening of bearing 5E of crank shaft 12. Passage cover 21B is a plate that has a substantially rectangular shape and is positioned to cover the inside of passage side wall 21A from the outer side thereof. Passage cover 21B is tightly fixed by a plurality of bolts 21C to the opening end of passage side wall 21A with a gasket (not shown) or the like therebetween. As a result, passage side wall 21A and passage cover 21B are held together in a fluid-tight manner. Outlet port 13B of water pump 13 opens to a lower end 21E of first passage section 21. The front end of second passage section 22 opens in a back section of a passage opening 24A of fourth passage section 24. Third passage section 23 is connected to water jacket 4A.

Fourth passage section 24 is formed from a passage opening 24A and a passage cover 24B (FIG. 9). Passage opening 24A is a frame-like member having a substantially rectangular shape that protrudes from the surface of partition wall 5C of crank case 2. Passage cover 24B is a plate having a substantially rectangular shape that closes the opening of passage opening 24A. Passage cover 24B is tightly fixed by a plurality of bolts 24C to the opening end of passage opening 24A with a gasket (not shown) or the like therebetween. As a result, passage opening 24A and passage cover 24B are held together in a fluid-tight manner. Fifth passage section 25 has a lower end that opens in a back section of passage opening 24A of fourth passage section 24, and an upper end that is connected to water jacket 3A.

The operation of cooling water passage 20 is now explained. First, cooling water from radiator 100 is sucked up to water pump 13 through intake pipe 40. The cooling water is then discharged in the direction of arrow A in FIG. 3 to first passage section 21 of cooling water passage 20 from outlet port 13B. Next, the cooling water flows along second passage section 22 in the direction of arrow B in FIG. 3, and also flows in the direction of arrow C along fourth passage section 24. Then, the cooling water flows in the direction of arrow D along fifth passage section 25, and is fed into water jacket 3A, thereby cooling front cylinder 3. The temperature of the cooling water is increased by cooling front cylinder 3. The cooling water flows out in the direction of arrow E from outlet port 3B, and is fed to radiator 100 to be cooled.

Cooling water discharged from outlet port 13B of water pump 13 in the direction of arrow A along first passage section 21 also flows in the direction of arrow F from second passage section 22. Next, the cooling water is fed into water jacket 4A, thereby cooling rear cylinder 4. The temperature of the water is increased by cooling rear cylinder 4. The cooling water flows out in the direction of arrow G from outlet port 4B, and is fed to radiator 100 to be cooled.

Engine 1 includes cooling water passage 20 formed in the surface of partition wall 5C that is the inside wall surface of crank case 2. Further, water pump 13 is housed inside crank case 2. Thus, cooling water passage 20 and water pump 13 are accommodated inside crank case 2, and are not exposed to the outside of engine 1. Accordingly, engine 1 has an improved and simple external appearance, like that of an air-cooled engine. In addition, cooling water passage 20 is formed integrally with crank case 2 using casting or the like. As a result, the water pipes, water hoses and the like described in the known art can be simplified or omitted, thereby reducing the number of component parts and manufacturing costs.

Furthermore, first passage section 21 of cooling water passage 20 is formed by passage side wall 21A that is formed integrally with the surface of partition wall 5C of crank case 2 and that extends in the up-down direction, and passage cover 21B that closes the opening of passage side wall 21A. As a result, first passage section 21 is formed easily by simply attaching passage cover 21B to passage side wall 21A. Thus, the ability to manufacture cooling water passage 20 is enhanced.

Moreover, fourth passage section 24 is also formed by passage opening 24A that is formed integrally with the surface of partition wall 5C of crank case 2, and passage cover 24B that closes the opening of passage opening 24A. As a result, fourth passage section 24 is formed easily by simply attaching passage cover 24B to the opening of passage opening 24A, and the ability to manufacture cooling water passage 20 is enhanced.

In addition, main shaft 11 and crank shaft 12 are provided in partition wall 5C of crank case 2, and first passage section 21 of cooling water passage 20 is positioned between main shaft 11 and crank shaft 12. Accordingly, cooling water passage 20 is easily positioned while making use of the space between main shaft 11 and crank shaft 12, thereby simplifying the layout of cooling water passage 20. Further, passage side wall 21A of first passage section 21 that has a substantially U-shaped cross section is formed integrally with partition wall 5C of crank case 2. As a result, first passage section 21 functions like a cross-beam member of crank case 2 and improves the rigidity of crank case 2.

The invention has been described with respect to an exemplary embodiment as a V-type 2-cylinder engine for a motorcycle. However, the invention is not so limited and may be applied, for example, to a V-type 4-cylinder engine or to an engine of a four-wheeled vehicle.

The particular embodiments of the invention described in this document should be considered illustrative, rather than restrictive. Modification to the described embodiments may be made without departing from the spirit of the invention as defined by the following claims.

The invention claimed is:

1. An engine comprising:
a crank case;
a water jacket;
a water pump; and
a cooling water passage that connects the water pump and the water jacket, wherein
the water pump is provided inside the crank case, and
the cooling water passage is formed inside the crank case and includes a passage side wall forming a frame shape that protrudes out from an inside wall of the crank case, and a passage cover provided on the passage side wall to close the frame shape of the passage side wall,
wherein a pump shaft of the water pump is disposed perpendicular to a flow direction of cooling water in the cooling water passage.

2. The engine according to claim 1, wherein the engine is a V-type engine having a front cylinder and a rear cylinder.

3. The engine according to claim 2, further comprising:
a one side passage that connects the cooling water passage and a water jacket of the front cylinder, and an other side passage that connects the cooling water passage and a water jacket of the rear cylinder.

4. The engine according to claim 3, wherein the cooling water passage includes a fourth passage section that is positioned between the front cylinder and the rear cylinder, and that connects the first passage section and the other side passage.

5. The engine according to claim 1, wherein the passage side wall has a rectangular shape.

6. The engine according to claim 5, wherein the passage cover is a plate having a rectangular shape that is fixed to an opening end of the passage sidewall in a fluid-tight manner.

7. The engine according to claim 1, further comprising:
a cylinder connected to the crank case, wherein
the water jacket is formed adjacent to the cylinder.

8. The engine according to claim 1, wherein the cooling water passage includes a first passage section extending in an up-down direction, and the water pump is provided at a lower end of the first passage section.

9. A motorcycle comprising the engine according to claim 1.

10. The engine according to claim 1, wherein the passage side wall is formed integrally with the inside wall of the crank case.

11. An engine comprising:
a crank case;
a water jacket;
a water pump;

a cooling water passage that connects the water pump and the water jacket;

a main shaft that supports a clutch plate; and a crank shaft, wherein the water pump is provided inside the crank case and is provided with an oil pump, and a pump shaft of the oil pump is positioned coaxially with the pump shaft of the water pump, the cooling water passage is formed inside the crank case and includes a passage side wall forming a frame shape that protrudes out from an inside wall of the crank case, and a passage cover provided on the passage side wall to close the frame shape of the passage side wall, the main shaft and the crank shaft are supported by the crank case, and the cooling water passage is positioned between a main shaft support portion and a crank shaft support portion of the crank case.

12. The engine according to claim 11, wherein the crank case is formed from a left case and a right case, and the cooling water passage is formed in either the left case or the right case.

* * * * *